US007026056B2

(12) United States Patent
Ragland

(10) Patent No.: US 7,026,056 B2
(45) Date of Patent: Apr. 11, 2006

(54) MULTICOMPARTMENT STRUCTURE FOR INSULATION AND OTHER MATERIALS

(75) Inventor: G. William Ragland, Dunwoody, GA (US)

(73) Assignee: ATD Corporation, Suwanee, GA (US)

( * ) Notice: Subject to any disclaimer, the term of this patent is extended or adjusted under 35 U.S.C. 154(b) by 0 days.

(21) Appl. No.: 10/964,580

(22) Filed: Oct. 13, 2004

(65) Prior Publication Data

US 2005/0118384 A1 Jun. 2, 2005

Related U.S. Application Data

(60) Division of application No. 10/044,895, filed on Jan. 9, 2002, now Pat. No. 6,824,887, which is a continuation of application No. 09/570,396, filed on May 12, 2000, now abandoned.

(51) Int. Cl.

| | |
|---|---|
| ***B32B 1/06*** | (2006.01) |
| ***B32B 1/04*** | (2006.01) |
| ***B32B 3/26*** | (2006.01) |
| ***B32B 15/01*** | (2006.01) |

(52) U.S. Cl. ..... 428/594; 428/597; 428/598; 428/601; 428/614; 428/573

(58) Field of Classification Search ..... 428/594, 428/597, 598, 601, 614, 573

See application file for complete search history.

(56) References Cited

U.S. PATENT DOCUMENTS

| | | | | |
|---|---|---|---|---|
| 4,782,570 | A * | 11/1988 | Spridco | 29/890 |
| 5,408,071 | A * | 4/1995 | Ragland et al. | 219/530 |
| 5,524,406 | A * | 6/1996 | Ragland | 52/406.2 |
| 5,658,634 | A * | 8/1997 | Ragland et al. | 428/75 |
| 5,800,905 | A * | 9/1998 | Sheridan et al. | 428/157 |
| 5,939,212 | A * | 8/1999 | Ragland et al. | 428/594 |
| 5,958,603 | A * | 9/1999 | Ragland et al. | 428/595 |
| 6,012,493 | A * | 1/2000 | Remke et al. | 138/38 |
| 6,099,809 | A * | 8/2000 | Foster et al. | 422/180 |
| 6,104,004 | A * | 8/2000 | Ragland et al. | 219/405 |
| 6,276,044 | B1 * | 8/2001 | Ragland et al. | 29/521 |
| 6,391,469 | B1 * | 5/2002 | Ragland et al. | 428/593 |
| 6,451,447 | B1 * | 9/2002 | Ragland et al. | 428/593 |
| 6,810,670 | B1 * | 11/2004 | Bruck et al. | 60/723 |
| 6,823,571 | B1 * | 11/2004 | Ragland et al. | 29/17.4 |

* cited by examiner

*Primary Examiner*—Deborah Jones
*Assistant Examiner*—Jason L Savage
(74) *Attorney, Agent, or Firm*—Matthew H.J. Kim

(57) ABSTRACT

A structure for encapsulating and protecting fiber insulation material as well as other materials in multicompartment devices in order to provide unitized material which can be applied to any surface desired for insulation or other purposes. A first sheet of material is formed with pockets or depressions in the sheet which are adapted for receiving the material desired to be unitized and a second sheet placed over the first sheet, and the two sheets are attached together in the areas between the pockets or depressions thus encapsulating the material in the pockets. The material is unitized by placing the material in individual sealed metal foil containers or compartments, then the individual containers of unitized material are attached in matrix form to a continuous sheet, such as positioning the containers in openings in the continuous sheet. The product can be applied to any surface desired for insulation or other purposes. Preferably a multilayer metal foil material is employed in the structures.

4 Claims, 1 Drawing Sheet

MULTICOMPARTMENT STRUCTURE FOR INSULATION AND OTHER MATERIALS

CROSS-REFERENCE TO RELATED APPLICATION

This application is a divisional of U.S. application Ser. No. 10/044,895, now U.S. Pat. No. 6,824,887 filed on Jan. 9, 2002, which is a continuation of U.S. patent application Ser. No. 09/570,396, now abandoned, filed May 12, 2000, both of which are incorporated herein by reference in their entirety.

FIELD OF THE INVENTION

This invention relates to insulation packaging and packaging of other materials, including devices and methods for same.

BACKGROUND OF THE INVENTION

Fiber insulation, which is in widespread use in various industries such as the appliance industry, is effective insulation and is low cost, but poses the initial problem of handling the fibers during installation of the insulation on the devices to be insulated. Various methods have been used to contain the fibers and protect workers from the fibers, such as encapsulating the fiber materials in plastic film. Such methods have proven inadequate in many uses due to the limitations imposed by the thermal requirements of a particular installation. In addition, fiber insulation frequently loses its effectiveness in various applications due to impregnation with moisture or other contamination from condensation of vapors. Consequently, there is a need for effective devices and methods for encapsulating fiber insulation for installation and to protect the fiber insulation long-term from contamination to maintain the insulation effectiveness.

SUMMARY OF THE INVENTION

This invention provides structures and methods for encapsulating and protecting fiber insulation material as well as other materials in multicompartment devices in order to provide unitized material which can be applied to any surface desired for insulation or other purposes. In a first aspect this invention provides that a first sheet of material is formed with pockets or depressions in the sheet which are adapted for receiving the material desired to be unitized. After the pockets or depressions are filled or partially filled with the material a second sheet is placed over the first sheet, then the two sheets are bonded or joined together in the areas between the pockets or depressions. For example, the first sheet can be a sheet of metal foil in which the pockets or depressions are formed by drawing, then after the material is placed in the pockets or depressions a second sheet of metal foil is placed over the first sheet and the two sheets bonded together in the areas between the pockets or depressions by welding, crimping, by adhesive or other means appropriate for the desired installation or use of the unitized material. In a preferred embodiment of this aspect of the invention, the first and/or second sheets comprise multilayer metal foil construction.

In another aspect of this invention the material is unitized by placing the material in individual sealed containers or compartments, such as metal foil containers, then the individual containers of unitized material are attached in matrix form to a continuous sheet which can be applied to any surface desired for insulation or other purposes. For example, in one embodiment of this aspect of the invention the fiber insulation or other material can be placed in metal foil pans which are then covered with metal foil lids and the edges rolled to seal the material in the metal foil containers having a rolled lip around the perimeter. A continuous sheet of material is then provided having cut-outs in the sheet adapted for receiving the metal foil containers where the containers are supported in the sheet by the rolled lip. The containers are then attached to the continuous sheet in any desired method such as spot welding, adhesive or otherwise, thereby providing a sheet of unitized insulation material or other material which can be applied to any surface desired for insulation or other purposes. In an alternative embodiment the containers or compartments of unitized material may be removably mounted in the continuous sheet, thus enabling removal and replacement of individual containers or compartments after the continuous sheet of unitized material has been installed on the surface desired. In a preferred embodiment of this aspect of the invention, the containers and/or continuous sheet comprise multilayer metal foil construction.

The multicompartment sheets of unitized material provided by this invention in its various aspects have a wide range of utility, such as in the appliance industry, the automotive industry, the aircraft industry, the construction industry, the packaging industry, including food and other materials. The multicompartment sheets of unitized material of this invention are readily designed for use as thermal insulation, acoustic insulation, material storage, material transport and other uses. In addition, the compartments and the multicompartment sheets can be designed to any desired size, shape and thickness for any desired application for the unitized material contained in the compartments. For example, the compartments in the continuous sheet can be of a small size and closely spaced together in a flexible sheet so that the sheet of unitized material can be applied to a curved or other surface, such as the interior wall of an aircraft fuselage. In such aircraft use aluminum foil, especially multilayer foil construction, compartments containing fiberglass or other insulation material can significantly increase burn-through time in the event of a fire. In another example, the compartments in the continuous sheet can be sized to match the size of a surface to be insulated, such as an oven wall. In such installation each compartment would match the size of each oven wall with the space between the compartments corresponding to the corner of the oven whereby the continuous sheet is sized with compartments containing fiber insulation sealed in each compartment and is adapted to be wrapped around the four sides of the oven and secured in place. In a preferred embodiment of this aspect of the invention, the compartments and/or continuous sheet comprise multilayer metal foil construction, which is particularly advantageous for enhanced thermal or acoustic insulation performance. The advantages of such unitized insulation in terms of ease of installation and worker protection as well as protecting the long-term efficiency of the insulation are apparent.

DESCRIPTION OF THE INVENTION

Figure 1:
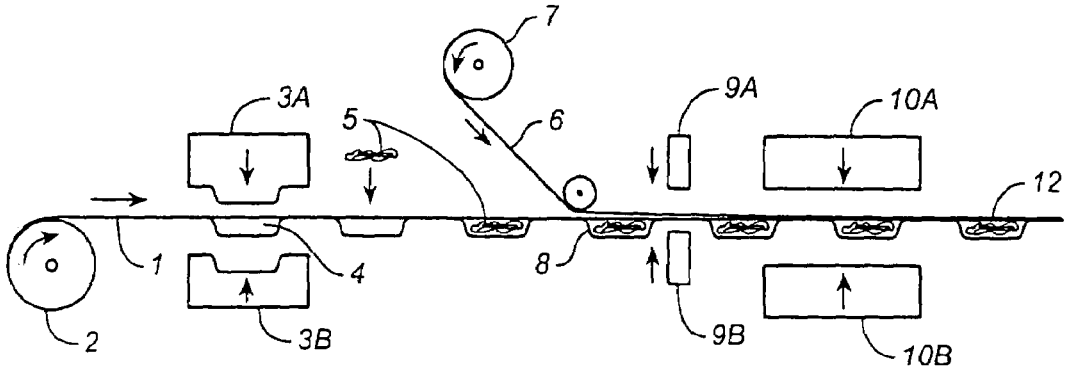
FIG. 1 is a cross-section schematic showing the continuous manufacture of a multicompartment product containing unitized material according to the present invention.
Figure 2:
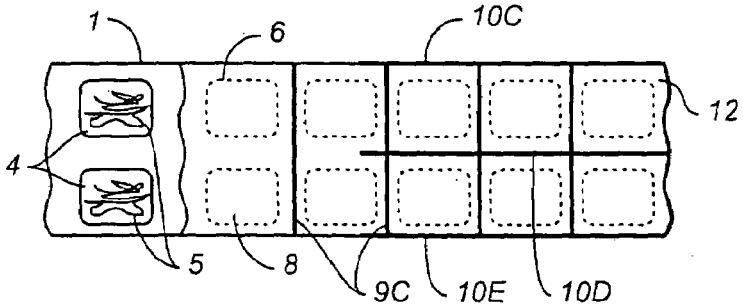
FIG. 2 is a top view of the multicompartment product as produced in FIG. 1.

The various aspects of this invention can be best understood by reference to the drawings. Referring to FIG. 1, a schematic illustration is made of the continuous manufacture of a multicompartment sheet made of metal foil in which the compartments contain fiber insulation material. Metal foil sheet 1 is supplied from roll 2 and is passed through drawing tool 3A and 3B which forms compartment 4 in sheet 1. The drawing tool 3A and 3B can be designed to draw compartments 4 in any size and any lengthwise spacing along sheet 1 and any desired number across the width of sheet 1. Fiber insulation material 5 is deposited in compartments 4 then sheet metal foil 6 is fed from roll 7 to cover the compartments and the entire surface of sheet 1. Sheets 1 and 2 are then passed through welding or crimping tool 9A and 9B which welds or crimps sheets 1 and 2 together across the width of the sheets in the space between compartments 4. Sheets 1 and 2 are then passed through welding or crimping tool 10A and 10B which welds or crimps sheets 1 and 2 together longitudinally along the length of the sheets in the spaces along the edges and between compartments 4. The resulting product 12 comprises the multicompartment structure of this invention whereby the fiber insulation 5 is provided in the unitized form in compartments 4. Product 12 can be cut into desired sizes for application to various devices for appropriate insulation as needed. FIG. 2 is a top view of product 12 showing the weld or crimp 9C across the width of the sheets and welds or crimps 10C, 10D and 10E longitudinally along the length of product 12.

As will be recognized by one skilled in the art following the above illustration of this aspect of the invention, the sheets utilized can be of any desired material, the compartments utilized can be of any desired size depth and spacing and the materials placed in and contained in the compartments can be any desired material, all depending on the end-use for which the product is intended. It will also be apparent to one skilled in the art that any desired and appropriate means for attaching or sealing the bottom sheet and top sheet together can be used depending on the end-use for which the product is intended and the available manufacturing machinery for producing the product and depending on whether the top and/or bottom metal sheets are metal foil or multilayer metal foil material. For example, the sheets can be attached or sealed together by adhesive strips, which may be thermoplastic or thermoset adhesive, by welding such as illustrated in U.S. Pat. No. 5,524,406, or by interlocking the top and bottom sheets from corrugations in the sheets utilizing the methods disclosed in U.S. Pat. No. 5,939,212. The disclosures of these patents are incorporated herein by reference in their entirety. In utilizing the crimping and interlocking of corrugations, the top and bottom sheets may be corrugated across their entire surfaces before the compartments are formed in the lower sheet and before the top sheet is placed on the bottom sheet to cover the filled compartments. When the sheets are placed together the corrugations can be nested then compressed and all the spaces between the filled compartments to simultaneously interlock the layers together and seal the compartments. The interlocking of the layers will occur as disclosed in the above U.S. Pat. No. 5,939,212. Alternatively, the sheets can be corrugated only in the areas between the compartments so that those corrugations in the top and bottom sheets can be nested and compressed to interlock the sheets in those areas. In combination therewith, the edge areas can be rolled and sealed as disclosed in U.S. Pat. No. 5,958,603. As will be apparent, various combinations of methods of sealing and interlocking the top and bottom sheets together may be used to confine the material in the compartments. All of the above methods and structures for attaching the sheets together are applicable whether one or all the sheets are metal, metal foil or multilayer metal foil material.

Figure 3:
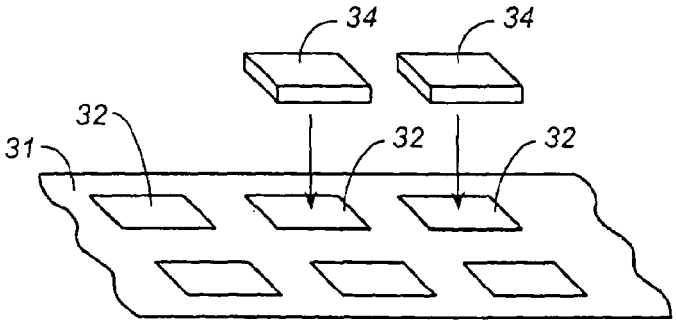
FIG. 3 is a prospective view of an alternative method of producing a multicompartment product containing unitized material according to the present invention.

Referring to FIG. 3 another aspect of this invention is illustrated. In this embodiment of the invention, a carrier sheet or bottom sheet 31 is provided with appropriately sized cut outs or holes 32. Separate containers 34 are constructed, filled with fiber insulation material, and sealed with a cover. For example, these containers can be made from metal foil, filled with fiber insulation, covered with a metal foil cover, then the edges rolled and sealed as disclosed in U.S. Pat. No. 5,958,603 the disclosure of which is incorporated herein by reference in its entirety. One advantage of having the containers with the rolled and sealed edge is that the rolled edge provides a convenient lip which supports the container when the container is placed in a cut out or hole 32 in carrier sheet 31. The containers 34 can be attached to carrier sheet 31 to prevent dislodging therefrom by any desired and appropriate method, including spot welding, adhesive, or by applying another sheet over the top of the containers 34 then welding or adhering the added top sheet to bottom sheet 31 to assure that containers 34 remain locked in position. As in the above embodiment, this aspect of the invention provides a product which can be sized to fit any desired application for which the fiber insulation is needed or desired in unitized form and can be designed with metal sheet, metal foil and/or multilayer metal foil material construction.

In another embodiment of this invention the bottom sheet containing compartments for receiving the unitized material can be a plastic sheet such as a vacuum formed sheet and the top sheet can be a metal foil or multilayer metal foil material. Conversely, the bottom sheet can be a metal foil sheet or multilayer metal foil material in which the compartments have been drawn as illustrated in the above embodiment and the top sheet can be a plastic sheet. In either of these embodiments the plastic sheet and the metal foil sheet can be attached and bonded at the appropriate areas between the compartments using the methods disclosed in U.S. Pat. No. 6,012,493 the disclosure of which is incorporated herein by reference in its entirety.

It will be apparent to one skilled in the art following the disclosure herein of the present invention that various and practically endless variations and permutations of the present invention can be created and employed to satisfy any particular need or requirement for unitized material, whether the material is insulation, material to be stored such as food, or other end use. For example, it is apparent that the compartments containing the unitized material can be sealed airtight or can be constructed with vents or can be constructed from mesh screen which is appropriate for containing the material unitized in the compartments. As another example, when metal foil sheets are used, single sheets of appropriate thickness may be used or multiple sheets of desired thickness may be used, for example, to enhance the insulating value of the multicompartment sheets containing unitized materials. In this regard the multilayer metal foil materials useful in the methods and products of this invention are disclosed in U.S. Pat. Nos. 5,658,634; 5,800,905; and in U.S. patent application Ser. No. 09/422,140 filed Oct. 20, 1999, published as PCT International Patent Application WO 00/23268, the disclosures of which are incorporated herein by reference in their entirety.

The materials useful in this invention will likewise be apparent to one skilled in the art and will include typically aluminum, stainless steel, copper, similar metal foils and metal sheets, plastic coated metal foils and sheets, laminates of metals, alloys of these and other metals, and metallic materials which are plastically deformable and are permanently deformable. In addition to metal, other materials may be interlayered between two or more of the metal foil layers in the embodiments of this invention which comprise multilayer metal foil structures. For example, plastic films, adhesive layers, spray on adhesives, coatings, etc. may be included between the metal foil layers, particularly in acoustic applications where additional sound damping is desired. The thickness of the various metal and other layers employed will depend on the end use application. It is preferred that the multilayer structure be made primarily of metal foils having a thickness of 0.006 in or less and in particular it is preferred that in, for example, a five layer structure, at least the three interior layers are thin metal foils, for example 0.002 in thick metal foils. The exterior layers of an all-foil structure are frequently desired to be heavier metal foils of 0.005 in. or 0.006 in. in thickness. Likewise, when the exterior layers are desired to be protective layers, they may be metal sheets of 0.010 or even up to 0.050 in. in thickness. In this regard, it is also recognized that the multilayer metal structures of this invention can be a non-foil structure made partially or entirely of layers of metal sheets thicker than metal foils, i.e., metal sheets having thicknesses in excess of 0.006 in. Thus, any metal foil layer described herein can be a metal sheet layer. For example, multilayer metal structures according to this invention can be made using five layers, three corrugated layers and two separation layers, of 0.010 in. thick metal sheets.

The number of layers and the thicknesses of each layer will be selected by one skilled in the art depending on the flexibility desired, the structural strength required in the final product, the capacity for lateral heat transfer, the requirements for thermal insulation, sound damping, etc. The thickness of various metal foil layers may vary from 0.0008 to 0.006 in., with the 0.002 in. and 0.005 in. metal foils being preferred for many applications. When heavier sheets are used and in particular for the top sheets or protective exterior sheets, the metal sheets can have a thickness of greater than 0.006 in. up to about 0.050 in., with the preferred top sheets or exterior sheets having a thickness of 0.010 in. to about 0.030 in. Some examples of combinations of number of layers and thicknesses of the alternating corrugated, embossed, smooth or other type of layers used in forming the multilayer metal foil structures of this invention are: (in mils, 1 mil=0.001 in.) 10/2/2/2/5; 5/2/2/2/5; 2/2/2/2/2/5; 5/2/2/2/2/10; 8/2/2/2/4; 10/2/2/10; 5/2/2; 5/2/2/8; 5/0.8/0.8/5; and 10/2/0.8/0.8/2/5. Examples of non-foil metal sheet structures are: 10/8/8/8; 30/10/10/10/30; 8/8/8; and 50/8/8/10. The foil and sheet materials useful in this invention are similar to those disclosed in U.S. Pat. No. 5,958,603 and U.S. Pat. No. 5,939,212, the disclosures of which are incorporated herein by reference.

Multicompartment devices made according to the multilayer structure of this invention will preferably have a total thickness from about 0.5 inch to about 1.0 inch or greater, depending on the number of layers, height of corrugations, height of embossments, etc., desired for a particular encapsulation or insulating application. For example, a typical 5-layer multilayer metal foil material will have a total thickness of between about 0.1 and 1.0 inch. A typical corrugation height (thickness of a single corrugated layer used in the multilayer metal foil material) will be between about 0.1 and 0.5 inch and preferably between about 0.2 and 0.4 inch. A typical embossment height of a single embossed layer used in the multilayer metal foil material will be between about 0.010 and 0.1 inch, preferably between about 0.020 and 0.080 inch, with 0.050 inch being a typical embossment height. Selection and assembly of appropriate layers for multilayer metal foil structures according to this invention will be apparent to one skilled in the art following the teachings herein.

Similarly it will be apparent to one skilled in the art that the material to be unitized in the compartments in the structure according to the present invention can be any desired material from insulation material to food materials, liquids, fiber, foam, particles or powders, fire retardant, etc. The compartments may be vacuum sealed for certain applications. In another application, the compartments may have appropriate vent openings and contain wood chips for use in out door grills and smokers. In this application, the continuous sheet can have perforations in the area between the compartments, so that a single compartment or multiple compartments can be detached from the continuous sheet for use as desired in the grill or smoker. This embodiment of the products of this invention can be adapted to various end uses.

It will also be apparent to one skilled in the art following the disclosure herein of the present invention that various modifications of the methods disclosed herein can be devised to form the multicompartment products of this invention containing the desired unitized materials. The methods illustrated herein are exemplary of the various ways in which the product of this invention can be produced.

I claim:

1. A multicompartment sheet of unitized material comprising:

a continuous sheet of metal foil having openings formed therein for receiving containers of material; and metal foil containers formed of material comprising multilayer metal foil having sheets having a rolled or crimped edge portion and adapted for insertion in the openings in the continuous sheet of metal foil;

wherein the containers are supported in the openings in the continuous sheet by the edge portion and are secured to the continuous sheet.

2. A multicompartment sheet of unitized material according to claim 1 wherein the continuous sheet comprises multilayered metal foil sheets.

3. A multicompartment sheet of unitized material according to claim 2 wherein the multilayered metal foil sheets further comprise of an at least one top sheet and an at least one bottom sheet that are at least in part interlocked together by compressing nested corrugations of the at least one top sheet and at least one bottom sheet.

4. A multicompartment sheet of unitized material comprising:

a continuous sheet of metal foil having openings formed therein for receiving containers of material; and metal foil containers having a rolled or crimped edge portion and adapted for insertion in the openings in the continuous sheet of metal foil;

wherein the containers are supported in the openings in the continuous sheet by the edge portion and are secured to the continuous sheet.

* * * * *